US012790659B2

(12) United States Patent
Anahid et al.

(10) Patent No.: US 12,790,659 B2
(45) Date of Patent: Nov. 10, 2026

(54) SELECTIVE HEAT TREATMENT OF METALS USING A COIL-IN-FURNACE SYSTEM

(71) Applicant: RTX Corporation, Farmington, CT (US)

(72) Inventors: Masoud Anahid, Galena, OH (US); Matthew D. Mordasky, Columbia, CT (US); Anthony Patrick Ventura, Glastonbury, CT (US); David U. Furrer, Marlborough, CT (US)

(73) Assignee: RTX CORPORATION, Farmington, CT (US)

( * ) Notice: Subject to any disclaimer, the term of this patent is extended or adjusted under 35 U.S.C. 154(b) by 701 days.

(21) Appl. No.: 18/162,861

(22) Filed: Feb. 1, 2023

(65) Prior Publication Data

US 2024/0254589 A1 Aug. 1, 2024

(51) Int. Cl.

| | |
|---|---|
| ***C21D 9/68*** | (2006.01) |
| ***C21D 1/42*** | (2006.01) |
| ***C22F 1/10*** | (2006.01) |

(52) U.S. Cl.

CPC ..... *C21D 9/68* (2013.01); *C21D 1/42* (2013.01); *C22F 1/10* (2013.01)

(58) Field of Classification Search

CPC ..... C21D 9/68; C21D 1/42; C22F 1/10

See application file for complete search history.

(56) References Cited

U.S. PATENT DOCUMENTS

| | | | | |
|---|---|---|---|---|
| 4,442,331 | A | 4/1984 | Watanabe | |
| 4,820,358 | A | 4/1989 | Chang | |
| 5,312,497 | A * | 5/1994 | Mathey | C22F 1/10 148/676 |

(Continued)

FOREIGN PATENT DOCUMENTS

| | | |
|---|---|---|
| EP | 3705591 A1 | 9/2020 |
| IN | 393810 | 7/2016 |

(Continued)

OTHER PUBLICATIONS

Asadzadeh et al. ("Hybrid modeling of induction hardening processes." Applications in Engineering Science 5 (2021): 100030.) (Year: 2021).*

(Continued)

*Primary Examiner* — Ricardo D Morales

(74) *Attorney, Agent, or Firm* — CANTOR COLBURN LLP

(57) ABSTRACT

The present disclosure provides assemblies, systems and methods for a single-step process for selective heat treatment of metals. More particularly, the present disclosure provides assemblies, systems and methods for a single-step process for selective heat treatment of metals using a coil-in-furnace configuration. A hybrid modeling-test approach can be used in the design process to improve or optimize the process parameters to achieve location specific and improved/optimal microstructure and residual stress to enhance the part performance. It is also noted that performing the selective heat treatment in a single step can reduce the cycle time significantly. Moreover, large thermal gradients can be avoided in the part as different volumes of the part are heated to their desired temperature simultaneously.

8 Claims, 2 Drawing Sheets

(56) References Cited

U.S. PATENT DOCUMENTS

| | | | |
|---|---|---|---|
| 5,527,020 | A | 6/1996 | Ganesh et al. |
| 6,660,110 | B1 | 12/2003 | Gayda et al. |
| 7,892,370 | B2 | 2/2011 | Ott et al. |
| 9,216,453 | B2 | 12/2015 | Hann et al. |
| 10,006,113 | B2 | 6/2018 | Demichael et al. |
| 10,677,300 | B2 | 6/2020 | Steele et al. |
| 10,837,069 | B2 | 11/2020 | Franchet et al. |
| 11,047,016 | B2 | 6/2021 | Furrer et al. |
| 11,136,634 | B2 | 10/2021 | Bridier et al. |
| 11,331,710 | B2 | 5/2022 | Hielscher et al. |
| 2010/0233504 | A1 | 9/2010 | Rice et al. |
| 2014/0255198 | A1 | 9/2014 | El-Wardany et al. |
| 2017/0268089 | A1 | 9/2017 | Gatto et al. |
| 2018/0371563 | A1 | 12/2018 | Franchet et al. |
| 2021/0180169 | A1 | 6/2021 | Arnett et al. |
| 2024/0254578 | A1 | 8/2024 | Anahid et al. |

FOREIGN PATENT DOCUMENTS

| | | | | |
|---|---|---|---|---|
| JP | S5794524 | A | * | 6/1982 |
| JP | S5811742 | B2 | | 3/1983 |
| JP | S6154612 | B2 | | 11/1986 |
| JP | S63266019 | A | | 11/1988 |

OTHER PUBLICATIONS

Extended European Search Report for EP Application No. 24155135.7; Issue Date, Jul. 4, 2024.

Extended European Search Report corresponding to EP Application No. 24155136.5; Mailing Date, Jun. 25, 2024.

Extended European Search Report corresponding to EP Application No. 24155141.5; Mailing Date, Jun. 19, 2024.

Gayda et al., "Low Cost Heat Treatment Process for Production of Dual Microstructure Superalloy Disks" NASA Technical Report No. 20030022720, 2003, pp. 1-18.

Fortier et al. "Chapter 8: Simulation Analysis. Computer Systems Performance and Prediction." pp. 251-277 (Year: 2003).

Frank et al. "Effect of nickel content on delta solvus temperature and mechanical properties of Alloy 718" 7th International Symposium on Superalloy 718 and Derivatives. The Minerals, Metals & Materials Society. pp. 725-736 (Year: 2010).

* cited by examiner

SELECTIVE HEAT TREATMENT OF METALS USING A COIL-IN-FURNACE SYSTEM

TECHNICAL FIELD

The present disclosure relates to assemblies, systems and methods for a single-step process for selective heat treatment of metals and, more particularly, to assemblies, systems and methods for a single-step process for selective heat treatment of metals using a coil-in-furnace configuration.

BACKGROUND

In general, there are existing dual heat treatment practices including a two-step process to produce dual property turbine disks. This can involve heat treating the entire part at a sub-solvus temperature, followed by re-solutioning the rim at a super-solvus temperature. Such process can produce the desired grain size in the bore and rim, but the microstructure in the transition zone is overaged/under-solutioned. This approach is experience-based and only considers the grain size in the design process.

BRIEF DESCRIPTION

The present disclosure provides assemblies, systems and methods for a single-step process for selective heat treatment of metals. More particularly, the present disclosure provides assemblies, systems and methods for a single-step process for selective heat treatment of metals using a coil-in-furnace configuration. It is noted that there is currently no conventional technology that utilizes multiple heating sources in a single step for the selective heat treatment of metals.

The present disclosure provides for a heat treatment assembly including a first heating source and a second heating source, the first heating source configured to be positioned relative to a first portion of a metal component, and the second heating source configured to be positioned relative to a second portion of the metal component; wherein the first and second heating sources are configured and dimensioned to provide selective heat treatment to the first and second portions of the metal component in a single-step process; and wherein the first heating source is a furnace, and the second heating source is an induction heating coil; and wherein the first portion of the metal component comprises the entire portion of the metal component, and the second portion of the metal component comprises a partial portion of the metal component.

In addition to one or more of the features described, or as an alternative to any of the foregoing embodiments, the first and second heating sources are independent of one another; and wherein the first heating source is in communication with a first power supply, and the second heating source is in communication with a second power supply.

In addition to one or more of the features described, or as an alternative to any of the foregoing embodiments, the metal component is configured to be positioned within the furnace to heat the metal component, and the induction heating coil is configured to be positioned relative to the second portion of the metal component to provide a coil-in-furnace configuration.

In addition to one or more of the features described, or as an alternative to any of the foregoing embodiments, the first and second heating sources are configured and dimensioned to provide selective heat treatment to the first and second portions of the metal component in a single-step process to achieve location specific microstructure and mechanical properties of the first and second portions of the metal component.

In addition to one or more of the features described, or as an alternative to any of the foregoing embodiments, wherein a hybrid modeling-test approach is utilized to achieve location specific microstructure and mechanical properties of the first and second portions of the metal component.

In addition to one or more of the features described, or as an alternative to any of the foregoing embodiments, the first heating source is configured to heat the first portion of the metal component to a first temperature in the single-step process; and wherein the second heating source is configured to heat the second portion of the metal component to a second temperature in the single-step process.

In addition to one or more of the features described, or as an alternative to any of the foregoing embodiments, the first temperature is different than the second temperature.

In addition to one or more of the features described, or as an alternative to any of the foregoing embodiments, the metal component comprises a nickel-chromium alloy, and wherein the first heating source is configured to heat the first portion of the nickel-chromium alloy to a sub-solvus temperature in the single-step process; and wherein the second heating source is configured to heat the second portion of the nickel-chromium alloy to a super-solvus temperature in the single-step process.

In addition to one or more of the features described, or as an alternative to any of the foregoing embodiments, the first and second heating sources are configured and dimensioned to provide selective heat treatment to the first and second portions of the metal component in a simultaneous single-step process.

The present disclosure provides for a method for selective heat treatment including placing a first portion of a metal component in a first heating source; and positioning a second heating source relative to a second portion of the metal component; and providing selective heat treatment to the first and second portions of the metal component, via the first and second heating sources, in a single-step process; and wherein the first heating source is a furnace, and the second heating source is an induction heating coil; and wherein the first portion of the metal component comprises the entire portion of the metal component, and the second portion of the metal component comprises a partial portion of the metal component.

In addition to one or more of the features described, or as an alternative to any of the foregoing embodiments, the first and second heating sources are independent of one another; and wherein the first heating source is in communication with a first power supply, and the second heating source is in communication with a second power supply.

In addition to one or more of the features described, or as an alternative to any of the foregoing embodiments, the metal component is placed within the furnace to heat the metal component, and the induction heating coil is positioned relative to the second portion of the metal component to provide a coil-in-furnace configuration.

In addition to one or more of the features described, or as an alternative to any of the foregoing embodiments, wherein providing selective heat treatment to the first and second portions of the metal component, via the first and second heating sources, in the single-step process achieves location specific microstructure and mechanical properties of the first and second portions of the metal component.

In addition to one or more of the features described, or as an alternative to any of the foregoing embodiments, further comprising utilizing a hybrid modeling-test approach to achieve location specific microstructure and mechanical properties of the first and second portions of the metal component.

In addition to one or more of the features described, or as an alternative to any of the foregoing embodiments, the first heating source heats the first portion of the metal component to a first temperature in the single-step process; and wherein the second heating source heats the second portion of the metal component to a second temperature in the single-step process.

In addition to one or more of the features described, or as an alternative to any of the foregoing embodiments, the first temperature is different than the second temperature.

In addition to one or more of the features described, or as an alternative to any of the foregoing embodiments, the metal component comprises a nickel-chromium alloy, and wherein the first heating source heats the first portion of the nickel-chromium alloy to a sub-solvus temperature in the single-step process; and wherein the second heating source heats the second portion of the nickel-chromium alloy to a super-solvus temperature in the single-step process.

In addition to one or more of the features described, or as an alternative to any of the foregoing embodiments, the first and second heating sources provide selective heat treatment to the first and second portions of the metal component in a simultaneous single-step process.

The above described and other features are exemplified by the following figures and detailed description.

Any combination or permutation of embodiments is envisioned. Additional features, functions and applications of the disclosed assemblies, systems and methods of the present disclosure will be apparent from the description which follows, particularly when read in conjunction with the appended figures. All references listed in this disclosure are hereby incorporated by reference in their entireties.

BRIEF DESCRIPTION OF THE DRAWINGS

The following figures are example embodiments wherein the like elements are numbered alike.

Features and aspects of embodiments are described below with reference to the accompanying drawings, in which elements are not necessarily depicted to scale.

Figure 1:
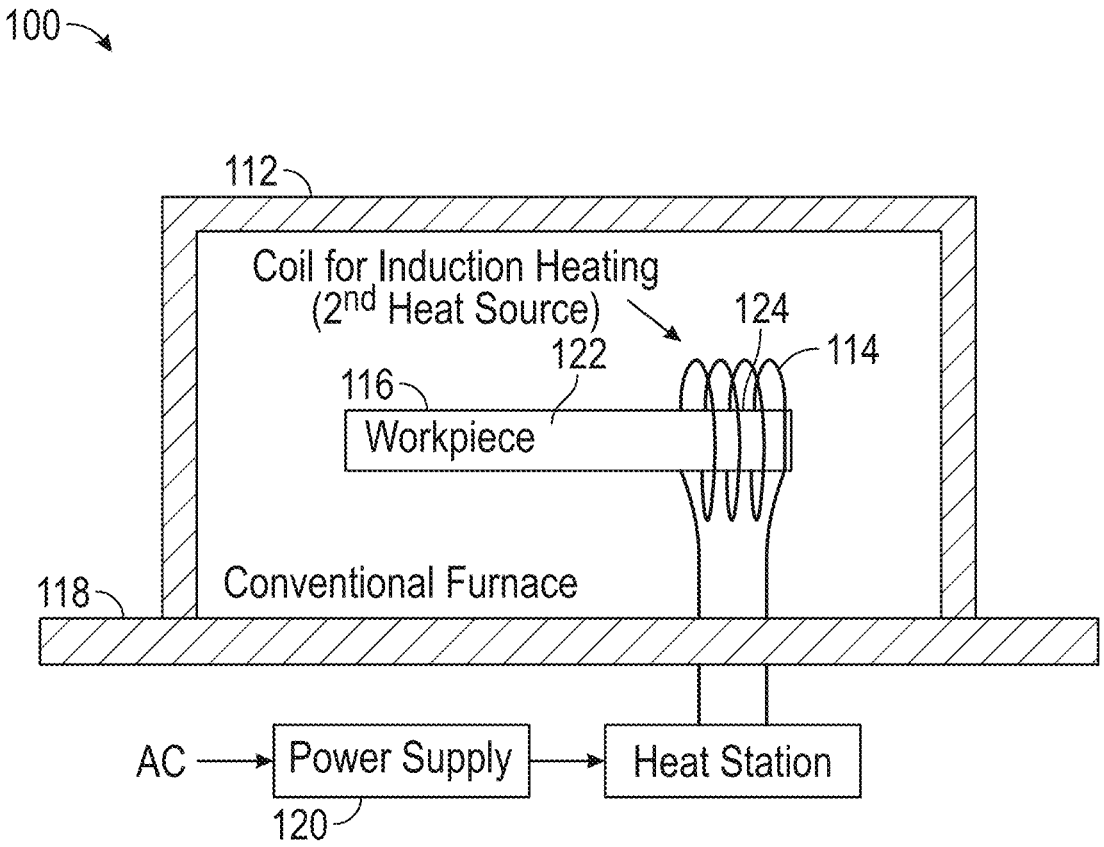
Figure 2:
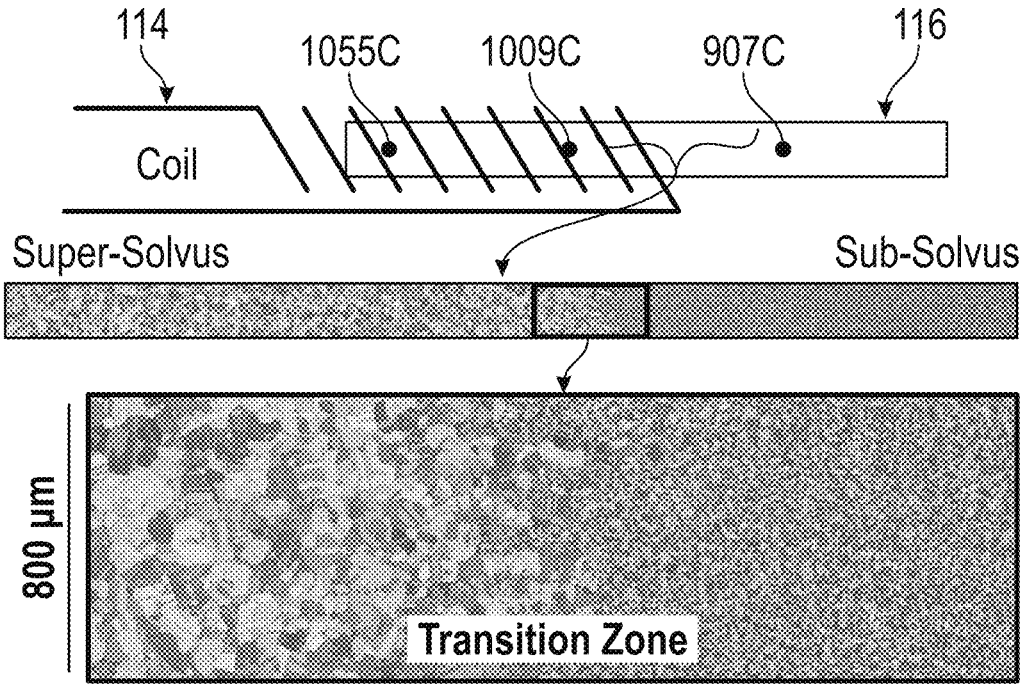

Example embodiments of the present disclosure are further described with reference to the appended figures. It is to be noted that the various steps, features and combinations of steps/features described below and illustrated in the figures can be arranged and organized differently to result in embodiments which are still within the scope of the present disclosure. To assist those of ordinary skill in the art in making and using the disclosed assemblies, systems and methods, reference is made to the appended figures, wherein:

FIG. 1 is a schematic of an example heat treatment assembly, according to the present disclosure;

FIG. 2 shows the electron backscatter diffraction (EBSD) map for a nickel-chromium alloy specimen/component heat treated using an example coil-in-furnace configuration/method.

DETAILED DESCRIPTION

The example embodiments disclosed herein are illustrative of assemblies for a single-step process for selective heat treatment of metals, and systems of the present disclosure and methods/techniques thereof. It should be understood, however, that the disclosed embodiments are merely examples of the present disclosure, which may be embodied in various forms. Therefore, details disclosed herein with reference to example assemblies for a single-step process for selective heat treatment of metals and associated processes/techniques of fabrication/assembly and use are not to be interpreted as limiting, but merely as the basis for teaching one skilled in the art how to make and use the assemblies/systems and/or alternative assemblies/systems of the present disclosure.

The present disclosure provides assemblies, systems and methods for a single-step process for selective heat treatment of metals.

More particularly, the present disclosure provides assemblies, systems and methods for a single-step process for selective heat treatment of metals using a coil-in-furnace configuration.

The present disclosure provides assemblies, systems and methods for using a coil-in-furnace configuration in a single step for selective heat treatment of metals in order to achieve location specific microstructure and mechanical properties. This technique works by heating different volumes of a component or part to their desired temperatures simultaneously. In this assembly/method, a furnace can be utilized as the main heating source and an induction coil can be used as the secondary heating source to heat a local region in the part above that of the remaining part. The temperature of the furnace and the amperage, geometry and location of the induction heater can be optimized using a hybrid modeling-test approach to achieve the required multi-temperature in the component/part.

There is currently no conventional technology that utilizes a coil-in-furnace configuration to produce parts with location specific properties.

In example embodiments of the present disclosure, a low frequency induction coil can be utilized to produce deep heat profiles without overheating the surface features in the parts with complex geometries.

The assemblies, systems and methods of the present disclosure have a broad applicability to various products where location specific properties are desired. It is noted that a hybrid modeling-test approach can be used in the design process to improve or optimize the process parameters to achieve location specific and improved/optimal microstructure and residual stress to enhance the part performance. It is also noted that performing the selective heat treatment in a single step can reduce the cycle time significantly. Moreover, large thermal gradients can be avoided in the part as different volumes of the part are heated to their desired temperature simultaneously.

As discussed further below, a water cooler running through the induction coil prevents it from heating up in the harsh environment of the furnace. Therefore, the furnace temperature can be increased as needed to produce the desired temperature in the component/part.

It is noted that there have been different dual heat treatment methods to produce dual property turbine disks. For example, a thermal gradient can be created in the part by using active cooling on the bore of the disk when it is placed into a conventional furnace or within an induction coil. See, for example, U.S. Pat. Nos. 5,312,497 and 5,527,020, the entire contents of each incorporated herein by reference in their entireties.

While these approaches produce the desired dual microstructure in the disk, fine grain bore and coarse grain rim, they add to the cost and complexity of the solution heat treatment. They also can require specialized air pressure lines going into a furnace that must remain operable for process viability. Another method involves insulating volumes to manage an optimal solution temperature for each volume.

There are existing dual heat treatment practices involving multiple heating sources. However, these processes are done in multiple steps with a single heating source used in each step.

An example is a dual heat treatment process to produce dual property turbine disks. To achieve the properties in the bore, the entire part is heat treated sub-solvus first in a conventional furnace. In the second phase the rim is resolutioned super-solvus using a local induction heating coil. The part is then aged after the dual-property heat treatment. This process does produce a fine grain structure in the bore and a coarse grain in the rim. However, the induction heating process creates a large thermal gradient from rim to the bore that produces a transition zone that is overaged/undersolutioned. This approach is experience-based and only considers the grain size in the design process. Precipitate size and residual stress are two other important characteristics which can significantly impact the part performance and are not necessarily optimized in the conventional process. The conventional method also results in increased cycle time as the heat treatment process is done in two steps. As such and as noted, there is currently no conventional technology that utilizes a coil-in-furnace configuration in a single step for the selective heat treatment of metals.

The present disclosure provides for using a coil-in-furnace configuration in a single step to perform a selective heat treatment with the goal of achieving location specific microstructure and mechanical properties. This technique, which is performed in a single step, works by heating different volumes of the part to their desired temperature simultaneously. In this method, a furnace is utilized as the main heating source and an induction coil is used as the secondary heating source to heat a local region in the part above that of the remaining part. The temperature of the furnace and the amperage, geometry and location of the induction heater are optimized to achieve the required multi-temperature in the part.

The assemblies, systems and methods of the present disclosure can be integrated with modeling to provide an engineered design system to optimize the process based on requirements of grain size, precipitation size and/or residual stress.

FIG. 1 is a schematic of an example heat treatment assembly 100, according to the present disclosure. In example embodiments, heat treatment assembly 100 includes a first heating source 112 and a second heating source 114. In general and as discussed further below, the first and second heating sources 112, 114 are configured and dimensioned to provide selective heat treatment to a metal component 116 in a single-step process.

As shown in FIG. 1, example first heating source 112 takes the form of a furnace, and the second heating source 114 takes the form of an induction heater (e.g., induction coil). In example embodiments, it is noted that induction coil 114 can include an extension (e.g., about a one-foot extension) for ease of inserting into the furnace 112. A water cooler can be running through the coil 114 (e.g., copper coil 114) to prevent it from heating up during use.

Example first heating source 112 can be in communication with a first power supply 118, and second heating source 114 can be in communication with a second power supply 120 (e.g., AC power supply). In example embodiments, the first and second heating sources 112, 114 are independent of one another.

As shown in FIG. 1, the metal component 116 can be positioned within the first heating source 112 to heat the entire first portion/volume 122 of the metal component 116 (e.g., all of component 116), and the example second heating source 114 can be positioned relative to a second portion/volume 124 of the metal component 116. As such, example heat treatment assembly 100 provides a coil-in-furnace configuration, where a furnace 112 is utilized as a main heat source and an induction coil 114 can be used as a secondary heating source to heat a local region 124 in the component/part 116 above that of the remaining region/portion 122 of the component/part 116 not heated by coil 114.

As such, the first and second heating sources 112, 114 of heat treatment assembly 100 can be utilized in a single-step process to provide selective heat treatment to metal component 116 (e.g., to achieve location specific microstructure and mechanical properties of metal component 116). This technique via heat treatment assembly 100 can operate by heating the different volumes 122, 124 of the component/part 116 to their respective (different, or similar) desired temperatures simultaneously (and in a single-step process). It is noted that a hybrid modeling-test approach can be used in the design process of assembly 100 to optimize the heating and cooling processes to achieve location specific and optimal microstructure and residual stress of metal component 116.

As such, FIG. 1 demonstrates a schematic of an example heat treatment assembly 100 with two independent heaters 112, 114. With respect to example heat treatment assembly 100, it is noted that process parameters and/or coil geometry and location for induction heater 114 can be utilized/optimized independently to achieve the required dual temperature in the portions 122, 124 of the component/part 116.

The assemblies, systems and methods of the present disclosure can provide improved quality components/parts 116 by enhancing the microstructure in the transition zone by eliminating the large thermal gradient that occurs using existing conventional dual heat treatment techniques in multiple steps.

FIG. 2 shows the electron backscatter diffraction (EBSD) map for a nickel-chromium alloy specimen/component 116 heat treated using the coil-in-furnace configuration/method as discussed relative to assembly 100 of FIG. 2. In this experiment, the first and second portions 122, 124 of the component/specimen 116 were heat treated sub-solvus (first portion 122) and super-solvus (second portion 124) simultaneously via assembly 100.

FIG. 2 shows the steady state temperature achieved in the specimen 116 at the end of the heating cycle and the EBSD map of the microstructure along the specimen. The transition zone exhibited a sharp grain size increase corresponding to a change of about three ASTM grain size number. Further grain growth occurred into the hot zone of the induction coil 114 after the transition.

It is noted that a proper grain structure profile is really specified by the material properties required in the part and can be different from one part to another. The coil-in-furnace configuration/process of the present disclosure can be optimized to achieve the desired microstructure profile based on property requirements in the component/part.

There are many benefits of the assemblies, systems and methods of the present disclosure, including, without limitation: providing for improved quality parts by enhancing the microstructure in the transition zone by eliminating the large thermal gradient which occurs using existing dual heat treat techniques; provides for significant reduction in cycle time as the selective heat treatment is performed in a single process; can be integrated with modeling to provide an engineered design system to optimize and/or improve the process based on requirements of microstructure (e.g., grain size, precipitation size) and residual stress; and/or using induction heaters with low frequency can create uniform and deep heating patterns in the part and this increases the efficiency of the heating system and results in better microstructure for parts with complex geometries.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). "Combinations" is inclusive of blends, mixtures, alloys, reaction products, and the like. The terms "first," "second," and the like, do not denote any order, quantity, or importance, but rather are used to distinguish one element from another. The terms "a" and "an" and "the" do not denote a limitation of quantity and are to be construed to cover both the singular and the plural, unless otherwise indicated herein or clearly contradicted by context. "Or" means "and/or" unless clearly stated otherwise. Reference throughout the specification to "some embodiments", "an embodiment", and so forth, means that a particular element described in connection with the embodiment is included in at least one embodiment described herein, and may or may not be present in other embodiments. In addition, it is to be understood that the described elements may be combined in any suitable manner in the various embodiments. A "combination thereof" is open and includes any combination comprising at least one of the listed components or properties optionally together with a like or equivalent component or property not listed.

Unless defined otherwise, technical and scientific terms used herein have the same meaning as is commonly understood by one of skill in the art to which this application belongs. All cited patents, patent applications, and other references are incorporated herein by reference in their entirety. However, if a term in the present application contradicts or conflicts with a term in the incorporated reference, the term from the present application takes precedence over the conflicting term from the incorporated reference.

Although the systems and methods of the present disclosure have been described with reference to example embodiments thereof, the present disclosure is not limited to such example embodiments and/or implementations. Rather, the systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. A method for selective heat treatment comprising:

placing a metal component in a furnace having an induction heating coil disposed therein such that a first portion of the metal component is within the furnace and outside a local heating region of the induction coil and a section portion of the metal component is within the furnace as well as within a local heating region of the induction heating coil;

heating the entire metal component via the furnace and the second portion of the metal component via the induction heating coil, in a single-step process to raise the first portion to a first temperature and the second portion to a second temperature; and running a coolant through the induction heating coil to cool the induction heating coil.

2. The method of claim 1, wherein the furnace and the induction heating coil are configured to operate independently of one another; and wherein the furnace is in communication with a first power supply, and the induction heating coil is in communication with a second power supply.

3. The method of claim 1, wherein the metal component is placed within the furnace to heat the metal component, and the induction heating coil is positioned relative to the second portion of the metal component to provide a coil-in-furnace configuration.

4. The method of claim 1, wherein heating the first portion of the metal component to the first temperature via the furnace and the second portion of the metal component to the second temperature via the induction heating coil in the single-step process achieves a location specific microstructure and mechanical properties of the first portion of the metal component and the second portion of the metal component.

5. The method of claim 4 further comprising utilizing a hybrid modeling-test approach to achieve the location specific microstructure and mechanical properties of the first portion of the metal component and the second portion of the meal component.

6. The method of claim 1, wherein the second temperature is greater than the first temperature.

7. The method of claim 1, wherein the metal component comprises a nickel-chromium alloy, further comprising heating the first portion of the nickel-chromium alloy to a sub-solvus temperature via the furnace in the single-step process; and heating the second portion of the nickel-chromium alloy to a super-solvus temperature via the induction heating coil in the single-step process.

8. The method of claim 1, further comprising heating the first portion to the first temperature and heating the second portion to the second temperature simultaneously in the single-step process.

* * * * *